United States Patent [19]

Hadl et al.

[11] 4,108,705

[45] Aug. 22, 1978

[54] BOTTLE OPERATED LABEL FEED SWITCH MECHANISM

[75] Inventors: Clyde F. Hadl; Shepard L. Harmon, both of Toledo, Ohio

[73] Assignee: Owens-Illinois, Inc., Toledo, Ohio

[21] Appl. No.: 785,634

[22] Filed: Apr. 7, 1977

[51] Int. Cl.[2] ..... B26D 5/00

[52] U.S. Cl. ..... 156/355; 156/363

[58] Field of Search ..... 156/300, 351-352, 156/361, 353-355, 446, 363, 366, 521, 522; 53/70, 71; 192/125 C

[56] References Cited

U.S. PATENT DOCUMENTS

| | | | |
|---|---|---|---|
| 1,799,106 | 3/1931 | Layo | 156/352 X |
| 2,329,669 | 9/1943 | Tuthill | 156/353 |
| 2,344,185 | 3/1944 | Tuthill | 156/351 |
| 2,875,564 | 3/1959 | Werge et al. | 53/70 |
| 2,909,017 | 10/1959 | Eddison et al. | 53/71 |
| 3,156,204 | 11/1964 | Harnish et al. | 192/125 C X |
| 4,021,286 | 5/1977 | Amberg | 156/446 |

*Primary Examiner*—David A. Simmons

*Attorney, Agent, or Firm*—John R. Nelson; Myron E. Click; David H. Wilson

[57] ABSTRACT

There is disclosed a control device for a sleeve label forming and applying machine of the type disclosed in U.S. Pat. No. 4,013,496, for labelling bottles, which controls the number of sleeves being fabricated to correspond with the number of bottles going through the machine. The control includes a pivoted switch arm across the bottle path at the outlet from a timing worm loading bottles into the machine. The arm when engaged by a bottle actuates its switch in the control circuit for engaging and disengaging the power drive means operating the supply of the label stock to the sleeve fabricating mechanism of the machine. The first bottle and every bottle into the machine is assured to receive a sleeve label, and the last bottle receives the last sleeve label fabricated.

4 Claims, 4 Drawing Figures

BOTTLE OPERATED LABEL FEED SWITCH MECHANISM

The present invention relates to labelling bottles or containers, and more particularly to mechanism controlling the label supply in response to the supply of bottles to be labelled.

BACKGROUND OF THE INVENTION

There is disclosed in U.S. Pat. No. 4,013,496 a machine and method for labelling bottles in which the label stock in the form of a web of a predecorated, labelled, heat shrinkable thermoplastic sheet material is advanced to a feed drum and rotary knife. The feed mechanism for the web and the feed drum and knife are driven by a common drive means. Also, the machine feeds bottles into pockets on a bottle turret mechanism timed from a conveyor and worm and synchronized with the feed of the label stock. The feed drum and knife produce lengths of label stock which are picked up by rotatable mandrels carried on the turret aligned over the bottle carrying pockets thereof. The machine winds each length of the label stock around a mandrel and side seals a seam thereof into a tube or sleeve form of a label which is axially shifted onto the coaxially located bottle in the pocket of the machine turret.

In the operation of the machine just described, any interruption in the flow of bottles into the machine will ordinarily result in the uncontrolled, continued production of label tubes or sleeves. The machine produces one sleeve for each bottle pocket on the turret while in operation, and if any pocket of the turret or a number of them fails to receive a bottle from the input line of the bottle supply, the mandrels continue to produce label sleeves which are discharged therefrom and wasted, or as may often happen, discharged freely into the machine to cause jam-ups or the like.

SUMMARY OF THE INVENTION

In the present invention there is provided a unique bottle switch and switch actuating arm which senses the bottles in the supply going into the pockets of the machine turret. The bottle sensing switch is in the circuit of the control solenoid of the clutch mechanism in the drive unit for the feed drum and feed rolls advancing the label stock to the mandrels for the making of the sleeves. Accordingly, after the last bottle in a continuous supply leaves the switch arm, the clutch shuts off the label stock feed to the mandrels. The mandrel turret and pockets are still rotated by their drive mechanism for operation of the machine to exhaust bottles and sleeves still on the turret. The entire machine is then shut down in a normal fashion. This assures the delivery of sleeves already on the mandrels to bottles already in the pockets of the turret. This match-up of sleeves and bottles is made by proper physical placement of the switch in the bottle supply line.

Placement of the switch actuating arm in the bottle input line enables a match of the distance on the turret between the mandrels so that the first sleeve produced in start up will match a bottle delivered to the turret; and, conversely, the last bottle to enter the turret from the supply will be assured a sleeve from the mandrels.

The bottle switch is actuated from a pivoted arm that is biased to extend it into the path of the bottles in the input conveyor serving the machine and is actuated thereby continuously. The arm of the switch is of sufficient length to allow a passing bottle to hold it open until a second following bottle makes contact with it. In other words, the contacting face of the switch arm is of sufficient length to contact two spaced bottles in a series simultaneously. This avoids cycling of the switch and the clutch circuit controlled by it, because once the switch is closed and bottles continue to pass through it, the switch is held closed. When the last bottle passing through the switch arm allows the arm to pivot freely and open the switch, the clutch is disengaged and fabrication of label sleeves from the web supply of label stock ceases. The last sleeve fabricated from label stock fed before the clutch is disengaged will match with the last bottle by equating the displacement the bottle must travel and the label sleeve must travel with its mandrel to the label station where the bottle is labelled in the machine. This is achieved by the selection of the placement of the bottle switch along the bottle supply conveyor. The bottles are fed into the pockets of the turret under the spacing (timing) of a worm, the spacing being provided by the worm being equal to the center-to-center spacing of the turret pockets. In turn, the turret pocket spacings are equal to the center-to-center spacing of the mandrels on the turret. Therefore, the displacement factor in placement of the bottle switch is important that the switch be located alongside the worm and the equal spacing increments may be equated in this simple manner.

Various modifications will undoubtedly occur to those skilled in the art upon reference to the preferred embodiment herein disclosed; however, the disclosed embodiment is in no way intended as limiting the invention beyond the scope set out in the appended claims.

DESCRIPTION OF THE INVENTION

Figure 1:
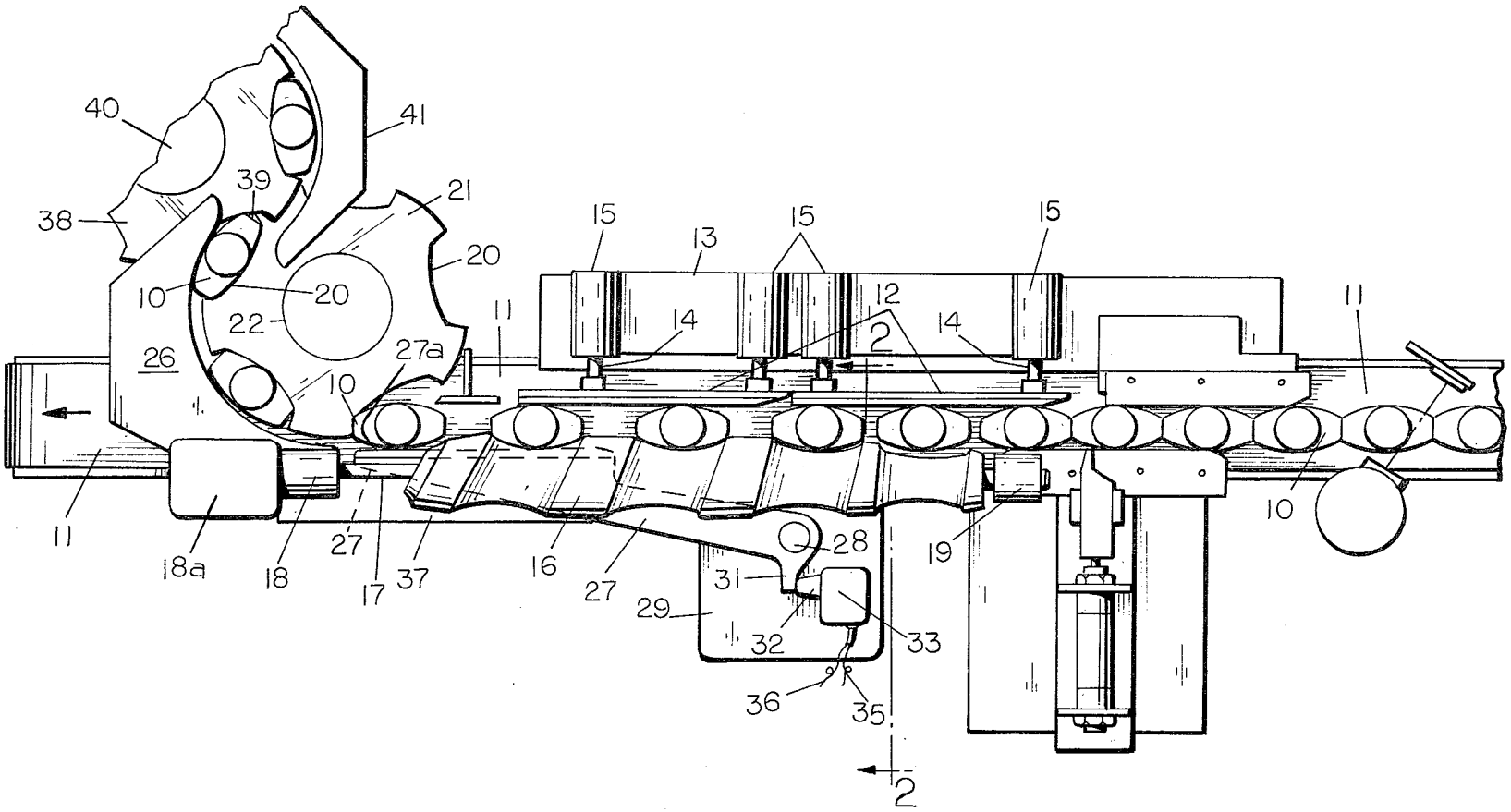
FIG. 1 is a top plan view of the bottle feed section of the bottle labelling machine, including the bottle sensing mechanism of the invention.

The drawings represent a preferred embodiment of the invention in which a seriatim supply of glass bottles 10 are supported in an upright fashion on a top horizontal run of a powered infeed conveyor 11. On FIG. 1, conveyor 11 is driven from right to left carrying the row of bottles 10 along a stationary side rail 12 formed in two end-to-end segments each supported by a side bracket assembly 13 of the conveyor frame and adjustable laterally through the position of rods 14 in the lateral holders 15 of the bracket assembly. Opposite the side rail 12 is a bottle timing and spacing device in the form of a helical worm element 16 rotated with a horizontal shaft 17 supported at opposite ends in bearings 18 and 19. The shaft 17 is driven in right-hand rotation for advancing the helical right-hand thread of worm element 16 from right to left. The spaced lands or threads of worm 16 form a bottle pocket 16*a*. The thread of worm 16 is of progressively increased axial pitch and of conventional design such that it receives bottles one at a time from the compacted row of bottles in side-to-side contact at the upstream end of the worm and advances them in controlled fashion to space them apart at a predetermined distance at the downstream, terminal end of the worm. This bottle spacing at the worm outlet will correspond to the center-to-center spacing between the bottle receiving pockets 20 about the periphery of star wheel 21. The star wheel is supported on a vertical shaft 22 that is driven in synchronized fashion with the turret 43 (FIG. 3) having a plurality of bottle pockets about its perimeter. Along the perimeter of star wheel 21 is a curved guide rail 26 retaining the bottles in the pockets of the star wheel.

Figure 2:
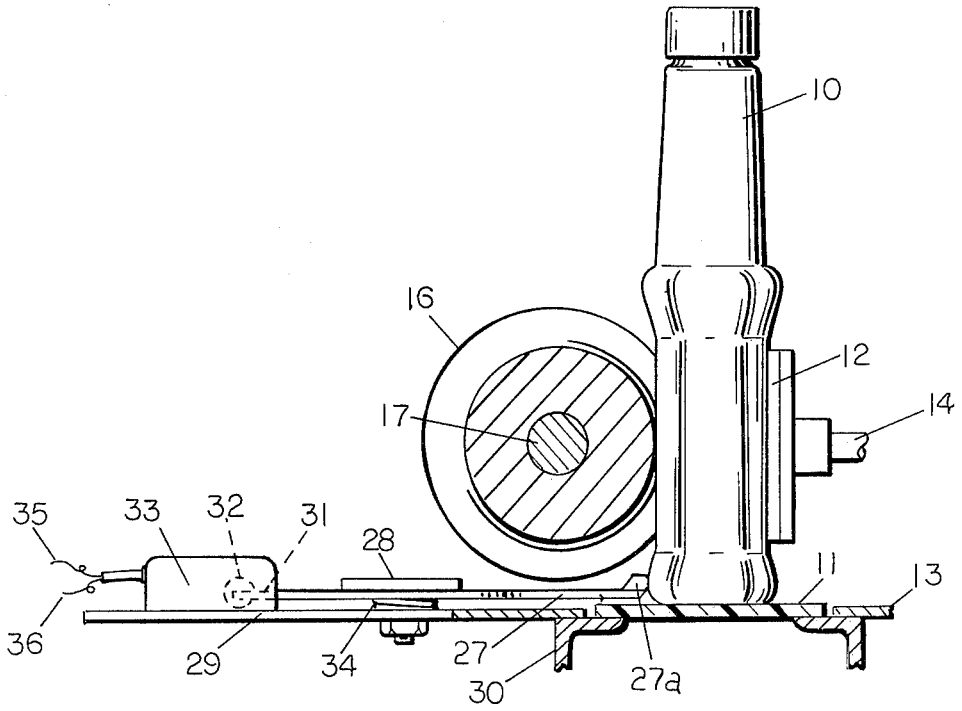
FIG. 2 is a sectional, elevational view taken along line 2—2 on FIG. 1.

At the side of the conveyor 11 and spaced slightly above the top surface thereof (FIG. 2) is an elongated, shaped switch arm 27 that is pivoted near its one end at the pivot post 28 supported on a side plate 29 attached to the frame 30 of the conveyor 11. The pivot post 28 is spring loaded by a coil spring 34 connected in the conventional manner to plate 29 and arm 27 normally biasing the switch arm 27 into the path of the bottles prescribed by the worm 16 and the side rail 12. The one end of the switch arm 27 beyond the pivot post 28 includes a dog 31 that is engageable by clockwise rotation of arm 27 with the switch button 32 of a switch 33 fastened in place on side plate 29. The switch is normally open in its control circuit and closed by bottle contact with the switch arm face 27*a* while bottles are moving through the path near the end of worm 16. The switch arm face 27*a* at the extremity of the arm opposite its one end is elongated and lies along the bottle path. The length of the arm face 27*a* should be sufficient to simultaneously contact two consecutive bottles 10 in the infeed path near the terminal end of worm 16, as is shown on FIGS. 1 and 3, to avoid cycling of switch 33 between successively spaced bottles coming off of the timing worm 16. The switch 33 has its electrical leads 35 and 36 in the control circuit of a clutch mechanism to be presently described.

Figure 3:
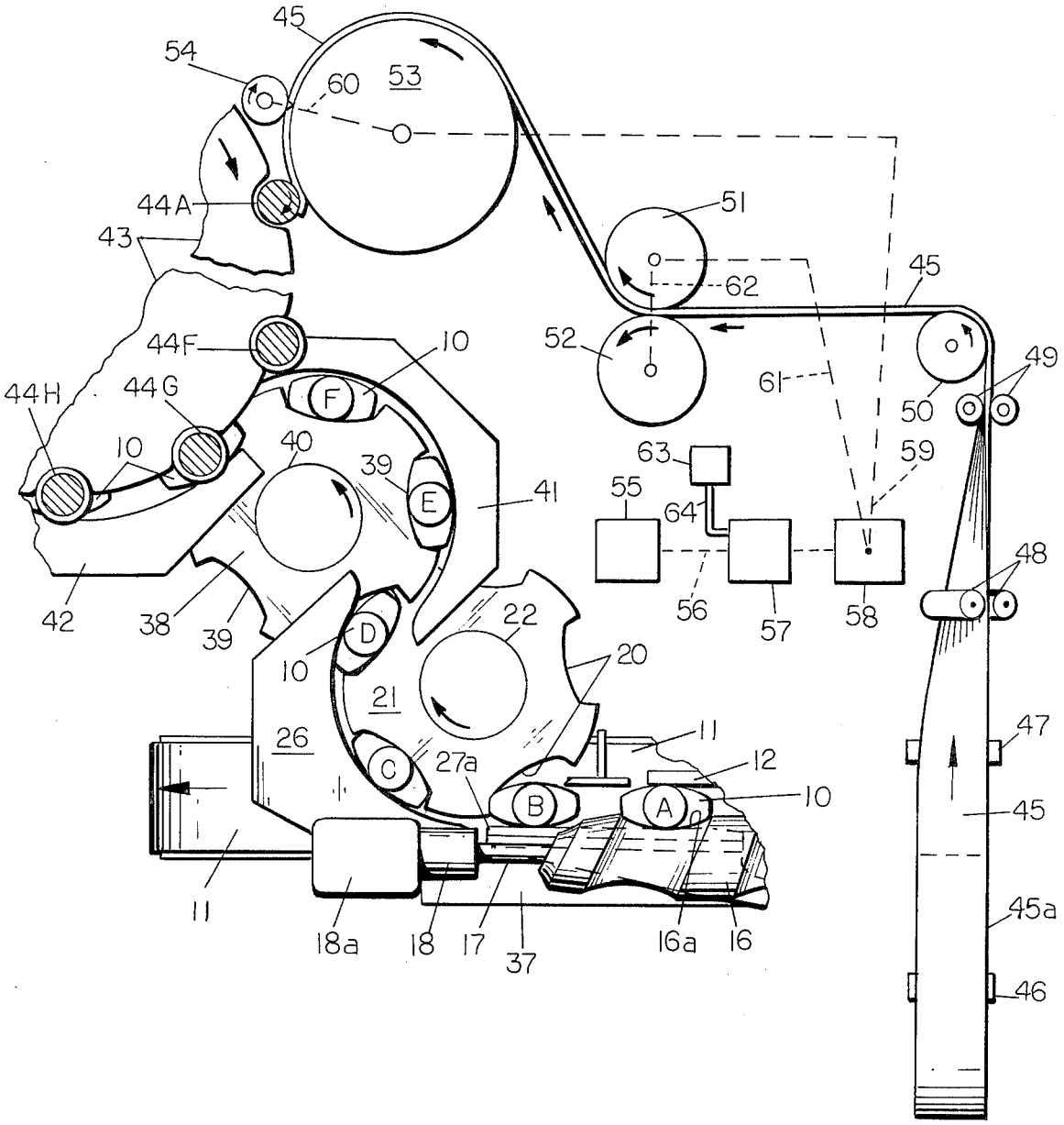
FIG. 3 is a partial top plan view partly broken away and partly schematic of the bottle labelling machine of FIG. 1 illustrating the invention.

Referring to FIG. 3, bottles 10 move into the pockets 39 of star wheel 38 which is in mesh with star wheel 21. Star wheel 38 is supported on its driven vertical shaft 40 and slightly above the plane of star wheel 21. As bottles enter a pocket 39 of the second star wheel (38), they are carried into the arcuate guide 41 which wipes the bottle from a pocket 20 and into a pocket 39 for movement along guide 41 and into loading position on the mandrel turret 43. The mandrel turret 43 has a pair of wheel members with pockets therein (not shown) which may be seen on FIG. 4 of the aforementioned U.S. Pat. No. 4,013,496. These turret pockets have their centers coaxial with the mandrels 44 carried on the upper turret spider 43. Once the bottles are loaded into the pockets of the wheel members of turret 43, the central axis of the bottle 10 in each wheel pocket is coaxially aligned with the axis of the mandrel overlying the pocket.

On the turret machine there are a plurality of mandrels, partly shown by 44A, 44F, 44G and 44H. As an example, 10-head and 15-head machines have been constructed and operated in accordance with U.S. Pat. No. 4,013,496. The heads are equally spaced around the periphery of the turret 43 and a corresponding number of bottle pockets in the turret wheel are provided. As star wheel 38 rotates toward the turret, each bottle 10 is brought into a pocket under a mandrel at the position of mandrel 44G on FIG. 3. As before, the bottle pockets of star wheels 38 and the turret machine mesh at this point. Thereafter, bottle 10 is kept in the pocket of turret 43 by the arcuate guide 42.

In the advance with the turret, a label already on the mandrel at the bottle loading station (turret mandrel 44G) is stripped vertically downwardly from the mandrel and over the bottle to proper labelling position. After this is achieved — placing the label on the bottle — the labelled bottle is diverted from the turret pocket and exits the machine, as is shown on FIG. 2 of U.S. Pat. No. 4,013,496. The worm 16, conveyor 11, star wheels 21 and 38 and the turret 43 are driven in synchronism by a first power drive means.

In the present invention, the apparatus on the machine feeding the web material to the mandrels by which the sleeve labels are made is under control of a second power drive means, which is synchronized for speed with the first drive means. It is the purpose of this invention to control the web supply to the mandrels in response to bottles furnished to the machine from the worm (16) such that every sleeve gets onto a bottle and every bottle gets a sleeve.

The label material is furnished as a predecorated continuous web 45 in a roll 45*a* supported on a roll stand which unwinds roll 45*a* on the horizontal shaft 46. Web 45 passes from roll 45*a* over a horizontal guide roll 47 and into the series of twister rolls 48 and 49 to twist the web on edge as it is fed over an idler cylinder roll 50. The web is pulled by the driven nip rolls 51 and 52 which control the advance of web 45 onto a vacuum feed drum 53. The feed drum 53 carries web 45 past a rotary knife 54 rotating in step with drum 53 to cut proper lengths of web 45 to form a sleeve label. The leading end of the cut lengths is picked up on a mandrel by vacuum, such as illustrated by mandrel 44A at the mandrel loading station located at a point tangent with feed drum 53. The rotation of the mandrels about their axis while moving with the turret at and after the loading station wraps the label length around the mandrel overlapping the leading and trailing ends thereof, and these overlapped ends are heat sealed together as a vertical side seam of the sleeve formed on the mandrel. As the mandrel registers with a bottle loaded onto the turret at the bottle loading station (position of mandrel 44G), the formed sleeve is shifted downwardly off the mandrel and onto the bottle, as earlier described.

The second power drive means is connected to drive the counter rotating nip rolls 51, 52, feed drum 53 and the rotary knife 54 in unison. This drive means includes electric motor 55 having a rotary coupling 56 to a transmission 58 through air-operated clutch 57, an example of which is air-operated timing clutch, Model No. 5H35T-SP, manufactured by Horton Manufacturing Company, Minneapolis, Minn. This clutch unit will start up the transmission in a phase synchronism for timing the web feed with the rotary operation of the labelling equipment driven by the first power drive means. The clutch 57 is air-operated by a controller in the form of a solenoid-operated control valve 63 which actuates the clutch to engage or disengage the motor 55 and transmission 58. The transmission 58 is coupled to the feed drum 53 by a conventional rotary drive connection 59. The rotary knife 54 is driven off the shaft of drum 53 by rotary coupling 60. The nip roll 51 is coupled to the transmission by a known rotary drive connection means 61 and roll 52 is driven off of roll 51 by a known drive connection 62. Accordingly, when clutch 57 couples motor 55 with transmission 58 in the operating (driving) mode, the nip rolls 51, 52, feed drum 53 and rotary knife 54 operate in unison and are synchronized or timed with the operation of turret 43.

Figure 4:
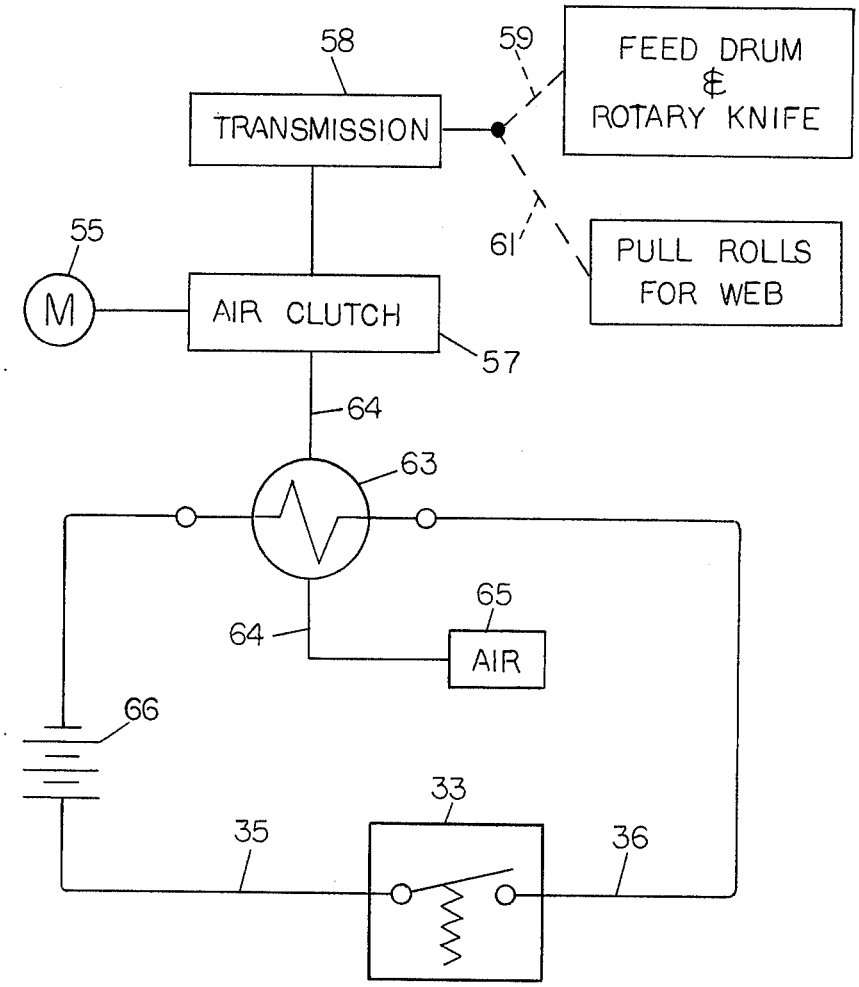
FIG. 4 is a schematic diagram of the machine drive means and control therefor operated in response to the bottle sensing mechanism of FIG. 2.

Referring to FIG. 4, the block diagram illustrates the control of the feed drum/knife and (nip) pull rolls for operation in response to bottle infeed by the bottle-operated switch 33. The circuit of the controller, the solenoid 63, includes the electric power source 66 connected across the solenoid in circuit 35, 36 with switch 33. The switch is spring biased and normally open, which de-energizes valve solenoid 63, and the air under pressure from source 65 connected by pipe 64 to air clutch 57 under the control of solenoid valve 63 normally sets the clutch in an inoperative mode (disengaged position) uncoupling motor 55 and transmission 58. When bottles 10 (FIG. 1) contact the face 27*a* of the switch arm 27, arm 27 is pivoted away from the bottle path, or in a counter-clockwise direction on FIG. 1. Dog 31 closes switch 33 energizing solenoid valve 63 (FIG. 4), which causes clutch 57 to engage and start up the pull rolls for the web and the feed drum/knife. This forms label lengths from web 45 and feeds them to the successive mandrels of the turret. Whenever bottles are absent in the path along switch arm face 27*a*, the converse occurs, i.e. the spring loaded (34) arm (27) is pivoted clockwise disengaging its dog 31 on switch 33, the latter then opening the circuit and setting solenoid-operated control valve 63 to disengage clutch 57 stopping the further production and feed of label sleeves.

One further important feature of the invention for achieving the match of sleeves and bottles in either start or stop modes is the following arrangement.

The bottle spacing between the bottles and number of spacings from worm 16 to the point where the sleeves are placed thereon equals the spacing between centers of the mandrels and number of mandrels from the mandrel loading station to the point where sleeves are placed on the bottles. The bottles 10 forward of the end land of worm 16 are labelled A through F and equally spaced apart up to and including their spacing in the wheel pockets of turret 43 underneath mandrels 44G and 44H, the latter two positions representing the bottle labelling station whereat the label sleeves are stripped from the mandrels and placed over the bottles. Similarly, the mandrels are spaced back a like amount of displacement around the turret periphery, the mandrels being indicated 44H to 44A. For the sake of ease of illustration, the turret is broken away which eliminates showing the mandrels between 44F and 44A. With the mandrel spacings between the mandrel loading station at 44A and the bottle labelling station at 44H being equal to the bottle spacings between the bottle under mandrel 44H and the bottle marked A in the end land 16*a* of worm 16, the sleeves made on the mandrels will always match up with bottles fed from the worm. For example, the bottle marked A on FIG. 3 will receive the sleeve label from the mandrel that is at that instant at the mandrel position 44A (the mandrel loading station). Accordingly, if bottle marked A is the last bottle in the infeed line it will ride over the switch arm face 27*a* until that bottle clears the switch arm; whereupon, the switch arm will rotate free into the bottle path and open switch 33. This will stop feed drum 53 and knife 54, plus the nip pull rolls 51, 52 stopping web 45 before another sleeve length can be severed therefrom and fed from the drum to a mandrel. All the sleeve labels already cut and on mandrels between 44A and 44H will continue through the bottle labelling station so that for each bottle in the system (A through F) a sleeve will be on its corresponding mandrel (44A through 44F); and, with the interruption of the infeed of bottles, all of the bottles already in the system ahead of the worm 16 will receive a sleeve. To put it another way, the last bottle in the line will receive a label sleeve, and no other label sleeves will be made until bottles again enter and engage the switch arm along its face 27*a*. When the latter event happens, the first bottle entering the line will at the position of bottle marked A re-close switch 33 and start up the second power drive means to resume feeding web 45 and making label sleeves to be picked up by mandrels in their loading station (at 44A). By the time the first bottle entering the line arrives at the bottle labelling station on the turret, the mandrel that will match up with it there will have the first formed sleeve thereon from this resumed production. Therefore, in the present invention the labels are fed to the mandrels in response to successive bottles contacting the switch arm.

In summary, the foregoing demonstrates the invention in providing for the match up of the last bottle and the last sleeve when the infeed of bottles is interrupted; and, conversely, for the match up of the first bottle and the first sleeve produced when the infeed of bottles is established or resumed. This assures that every bottle fed into the machine receives a label and no bottles go through the production unlabelled; and, on the other hand, avoids fabricating labels where no bottles will be present, obviating the situation where labels are discharged from the mandrels without a bottle being present. The control just described prevents fouling and jams in the machine by free discharge of these unneeded labels. The bottle detecting switch arm and its placement readily enables matching the first or last label sleeve with the first or last bottle, as the case may be, and does so in a simplified and reliable way in control of the machine production.

Having described a preferred embodiment of the invention, other and further modifications thereof may be resorted to without departing from the spirit and scope of the invention set forth in the appended claims.

What is claimed is:

1. In a bottle labelling machine having a rotary turret and a plurality of sleeve forming mandrels thereon, pocketed wheel means on the turret beneath the mandrels, the pockets thereof adapted to receive upright bottle and carry them on the turret means connected for driving the turret and its said pocketed means in continuous rotation, in axial alignment with the mandrels, a first power-operated continuously operable, moving horizontal infeed conveyor for advancing bottles thereon in upright position to the turret, a web supply of label material, a feed drum adjacent the turret adapted to feed a length of label material to each of the mandrels moving past the feed drum adjacent the turret adapted to feed a length of label material to each of the mandrels moving past the feed drum at a label loading station, web advancing means engaging said web for moving it to the feed drum, knife means operatively connected to the feed drum for cutting label lengths from said web thereon, the mandrels being operated to wrap said length thereon and form a label sleeve during turret rotation from the sleeve loading station a predetermined advanced distance to a bottle labelling station, the improvement therein comprising:

a timing means along the infeed conveyor for engaging upright bottles moving thereon and equally spacing and timing them to correspond with the turret pockets, means advancing the upright bottles seriatim from said timing means into the pockets on the turret ahead of the bottle labelling station, a second power-operated drive means engageable for actuating the feed drum, knife means and web advancing means in unison, a means for operatively engaging and for disengaging said second drive means including an electrically-operated controller therefor, a horizontal switch-actuating arm pivotally mounted and biased for movement into the path of the timed upright bottles passing the timing means and pivoted by contact with said timed bottles, said arm being positioned for contacting said bottles a distance along the path therefor to the bottle labelling station that equals the distance in the mandrel path between the mandrel loading station and the bottle labelling station, and an energizing circuit connected to said controller and including a switch operated by said arm in response to said bottle contact therewith for operatively engaging said second drive means, whereby labels are fed to the mandrels at the mandrel loading station only in response to said bottles contacting said arm.

2. The bottle labelling machine of claim 1 wherein the timing means comprises a rotating worm and a laterally spaced side rail on the conveyor along the worm for guiding bottles into the worm for controlled movement along the latter, the worm and rail providing a pocket at the end thereof adapted for continuously discharging bottles in said spaced, timed relationship to correspond with continuous movement of turret pockets, said arm contacting said bottles in the worm end pocket.

3. The bottle labelling machine of claim 1 in which the second power-operated drive means comprises a drive motor, a rotary power transmission and a rotary driving connection means from said transmission to the web advancing means and to the feed drum, the means for engaging and disengaging the second drive means comprises a rotary drive connection between said drive motor and said transmission including an air-operated clutch, said clutch being operated by the controller, the latter comprising an electrically-operated solenoid valve for operating the clutch to engage and disengage the drive motor and the transmission, the solenoid valve being in the circuit of the switch arm-operated switch.

4. The bottle labelling machine of claim 2 in which the switch actuating arm includes an elongated longitudinal face extending along the path of the bottles in the infeed path, its length being sufficient to contact at least two adjacent, spaced, consecutively timed bottles simultaneously in said worm including a bottle in the worm end pocket.

* * * * *